US008986840B2

(12) United States Patent
Fang et al.

(10) Patent No.: US 8,986,840 B2
(45) Date of Patent: Mar. 24, 2015

(54) POLYCRYSTALLINE ULTRA-HARD MATERIAL WITH MICROSTRUCTURE SUBSTANTIALLY FREE OF CATALYST MATERIAL ERUPTIONS

(75) Inventors: Yi Fang, Provo, UT (US); Charles Jeffrey Claunch, Payson, UT (US)

(73) Assignee: Smith International, Inc., Houston, TX (US)

( * ) Notice: Subject to any disclaimer, the term of this patent is extended or adjusted under 35 U.S.C. 154(b) by 2088 days.

(21) Appl. No.: 11/612,272

(22) Filed: Dec. 18, 2006

(65) Prior Publication Data

US 2007/0144790 A1 Jun. 28, 2007

Related U.S. Application Data

(60) Provisional application No. 60/752,927, filed on Dec. 21, 2005.

(51) Int. Cl.

| | |
|---|---|
| ***B32B 9/00*** | (2006.01) |
| ***B32B 15/04*** | (2006.01) |
| ***B24D 3/02*** | (2006.01) |
| ***C09C 1/68*** | (2006.01) |
| ***C09K 3/14*** | (2006.01) |
| ***E21B 10/567*** | (2006.01) |
| ***C01B 31/06*** | (2006.01) |

(Continued)

(52) U.S. Cl.

CPC ..... *E21B 10/567* (2013.01); *C01B 31/06* (2013.01); *C22C 1/1036* (2013.01); *B22F 2999/00* (2013.01); *C22C 26/00* (2013.01); *C22C 2204/00* (2013.01)

USPC ..... 428/408; 428/469; 51/307; 51/309

(58) Field of Classification Search

CPC ..... C01B 31/06; C22C 1/1036; C22C 26/00; E21B 10/567; B22F 3/14

USPC ..... 428/408, 469; 51/307, 309

See application file for complete search history.

(56) References Cited

U.S. PATENT DOCUMENTS

| | | | | |
|---|---|---|---|---|
| 4,097,274 | A | 6/1978 | Bakul et al. | |
| 5,379,854 | A * | 1/1995 | Dennis | 175/434 |

(Continued)

FOREIGN PATENT DOCUMENTS

| | | |
|---|---|---|
| EP | 1 190 791 A3 | 4/2002 |
| GB | 2413813 A | 9/2005 |

OTHER PUBLICATIONS

Patents Act 1977: Search Report under Section 17(6) referencing corresponding British Patent Application GB0625362.9, filed Dec. 20, 2006.

*Primary Examiner* — Shuangyi Abu Ali

(74) *Attorney, Agent, or Firm* — Snell & Wilmer L.L.P.

(57) ABSTRACT

Polycrystalline ultra-hard materials and compacts comprise an ultra-hard material body having a polycrystalline matrix of bonded together ultra-hard particles, e.g., diamond crystals, and a catalyst material disposed in interstitial regions within the polycrystalline matrix. The material microstructure is substantially free of localized concentrations, regions or volumes of the catalyst material or other substrate constituent. The body can include a region extending a depth from a body working surface and that is substantially free of the catalyst material. The compact is produced using a multi-stage HPHT process, e.g., comprising two HPHT process conditions, wherein during a first stage HPHT process the catalyst material is melted and only partially infiltrates the precursor ultra-hard material, and during a second stage further catalyst material infiltrates the precursor ultra-hard material to produce a fully sintered compact.

19 Claims, 8 Drawing Sheets

(51) Int. Cl.
*C22C 1/10* (2006.01)
*C22C 26/00* (2006.01)

(56) References Cited

U.S. PATENT DOCUMENTS 5,544,713 A * 8/1996 Dennis ..... 175/434
5,662,720 A * 9/1997 O'Tighearnaigh ..... 51/295
6,544,308 B2 * 4/2003 Griffin et al. ..... 51/309
7,350,601 B2 * 4/2008 Belnap et al. ..... 175/434
7,441,610 B2 * 10/2008 Belnap et al. ..... 175/374
2003/0192259 A1 10/2003 D'Evelyn et al.
2005/0115744 A1 6/2005 Griffin et al.
2005/0139397 A1 6/2005 Achilles et al.

* cited by examiner

POLYCRYSTALLINE ULTRA-HARD MATERIAL WITH MICROSTRUCTURE SUBSTANTIALLY FREE OF CATALYST MATERIAL ERUPTIONS

RELATION TO COPENDING PATENT APPLICATION

This application claims priority from U.S. Provisional Patent Application Ser. No. 60/752,927, filed on Dec. 21, 2005, which is incorporated herein in its entirety.

FIELD OF THE INVENTION

This invention generally relates to polycrystalline ultra-hard materials and, more specifically, to polycrystalline diamond materials and compacts formed therefrom that are specially engineered having a material microstructure that is substantially free of substrate material eruptions and the localized concentrations, regions or volumes of substrate constituent, e.g., catalyst material, that are associated therewith, thereby providing a polycrystalline ultra-hard material having improved properties of thermal stability and mechanical strength when compared to conventional polycrystalline diamond materials that include such eruptions.

BACKGROUND OF THE INVENTION

Polycrystalline diamond (PCD) materials and PCD elements formed therefrom are well known in the art. Conventional PCD is formed by combining diamond grains with a suitable solvent catalyst material and subjecting the diamond grains and solvent catalyst material to processing conditions of extremely high pressure/high temperature (HPHT). During such HPHT processing, the solvent catalyst material promotes desired intercrystalline diamond-to-diamond bonding between the grains, thereby forming a PCD structure. The resulting PCD structure produces enhanced properties of wear resistance and hardness, making PCD materials extremely useful in aggressive wear and cutting applications where high levels of wear resistance and hardness are desired.

Solvent catalyst materials that are typically used for forming conventional PCD include metals from Group VIII of the Periodic table, with cobalt (Co) being the most common. Conventional PCD can comprise from 85 to 95 percent by volume diamond and a remaining amount of the solvent catalyst material. The solvent catalyst material is present in the microstructure of the resulting PCD material within interstices or interstitial regions that exist between the bonded together diamond grains.

The solvent catalyst material is typically provided during the HPHT process from a substrate that is to be joined together with the resulting PCD body, thereby forming a PCD compact. When subjected to the HPHT process, the solvent catalyst material within the substrate melts and infiltrates into the adjacent diamond grain volume to thereby catalyze the bonding together of the diamond grains.

The HPHT process conventionally used to form PCD is one that involves elevating the temperature and pressure of the diamond grain volume and catalyst material to a desired sintering condition rapidly in a single step. For example, such conventional PCD is formed by subjecting the diamond grain volume and catalyst material in a single step to a temperature of approximately 1,450° C. and a pressure of approximately 5,500 MPa using a cubic press. During this temperature and pressure condition, the solvent catalyst material rapidly melts and infiltrates into the diamond grain volume and catalyzes the intercrystalline bonding together of the diamond grains to form PCD.

A problem known to exist with such conventional PCD materials is that during such single-step HPHT process, one or more constituent materials in the substrate are known to melt and infiltrate into the diamond grain volume so rapidly that that results in the eruption of such one or more constituent materials from the substrate and into the adjacent diamond grain volume. While a known substrate constituent material that undergoes eruption is the catalyst material, other substrate constituent materials such as tungsten carbide can be introduced into the diamond grain volume, e.g., when the substrate comprises tungsten carbide.

Because the sintering temperature exceeds the melting temperature of the solvent catalyst material in the substrate, the rapid escalation of the solvent catalyst material under these conditions causes the solvent catalyst material within the substrate to erupt therefrom and into the diamond grain volume. Such eruption of the catalyst material is known to result in the formation of localized concentrations, regions or columns of the catalyst material or other substrate constituents within the sintered microstructure, in the form of columns that extend vertically from the substrate interface and through the diamond grain volume.

The presence of such columns or localized concentrations of the catalyst material is not desired because: (1) they can reduce the effective amount of the diamond grains that are bonded together during HPHT processing due to the concentrated rather than distributed arrangement of the of the catalyst material within the diamond grain volume: (2) the presence of such densely concentrated regions of catalyst material can impair formation of an uninterrupted polycrystalline diamond matrix, which can reduce the strength and toughness of the PCD material; and (3) such columns or localized concentrated regions of the catalyst material within the PCD material can provide a source of large thermal expansion differences within the microstructure, as the catalyst material is known to have a coefficient of thermal expansion different from that of the surrounding polycrystalline diamond matrix, and the presence of such concentrated regions of catalyst material can thereby operate to reduce the overall thermal stability of the PCD material.

It is, therefore, desired that a polycrystalline ultra-hard material be developed and constructed in a manner that avoids such unwanted substrate material eruption, thereby minimizing or eliminating the presence of such localized concentrated regions or volumes of the catalyst material or other substrate constituents within the resulting sintered product. It is desired that polycrystalline ultra-hard materials developed in this manner have improved properties of toughness, strength and thermal stability when compared to those of conventional PCD comprising such unwanted localized concentrated regions or columns the catalyst material or other substrate constituents caused from catalyst material eruption during sintering as described above.

It is further desired that such polycrystalline ultra-hard materials be engineered to include a suitable substrate to form a compact construction that can be attached to a desired wear and/or cutting device by conventional method such as welding or brazing and the like. It is still further desired that such polycrystalline ultra-hard material and compacts formed therefrom be manufactured at reasonable cost without requiring excessive manufacturing times and without the use of exotic materials or techniques.

SUMMARY OF THE INVENTION

Polycrystalline ultra-hard materials and compacts formed therefrom are prepared comprising an ultra-hard material body. The polycrystalline ultra-hard material includes a polycrystalline matrix of bonded together ultra-hard particles. In an example embodiment, the ultra-hard particles are diamond crystals and the ultra-hard material body comprises a diamond-bonded body. The ultra-hard material body includes a catalyst material that is disposed in a plurality of interstitial regions that exist within the polycrystalline matrix. In the example embodiment, where the ultra-hard material body is a diamond-bonded body, the catalyst material can be a metal solvent catalyst.

A feature of the polycrystalline ultra-hard material body is that it have a material microstructure that is substantially free of substrate material eruptions, e.g., catalyst material eruptions, and, thus free of localized concentrations, regions or volumes of substrate constituent material such as the catalyst material. The catalyst material in the polycrystalline ultra-hard material body is evenly dispersed therethrough, and the body is substantially free of any localized concentrations, regions or volumes of the catalyst material. Further, the body is substantially free of any other substrate constituent materials. If desired, the polycrystalline ultra-hard material body can include a region that extends a depth from a body working surface that has been treated to remove the catalyst material therefrom so that such region is substantially free of the catalyst material.

The polycrystalline ultra-hard material compact is prepared by subjecting the substrate and a precursor polycrystalline ultra-hard material to a multi-stage HPHT process. In an example embodiment, the compact is prepared by subjecting the substrate and precursor polycrystalline ultra-hard material to a first HPHT process condition for a period of time, and then subjecting it to a second HPHT process condition to produce a completely sintered product.

In such example embodiment, the first HPHT process condition is held at a temperature that is sufficient to melt the catalyst material and cause a partial amount of catalyst material infiltration into the precursor polycrystalline ultra-hard material. During this first HPHT process condition, it is desired that the precursor material comprise at least about 10 percent by volume catalyst material. The second HPHT process condition is conducted at a temperature that is higher than the first HPHT process condition to cause further catalyst material infiltration to produce a fully sintered polycrystalline ultra-hard material.

BRIEF DESCRIPTION OF THE DRAWINGS

These and other features and advantages of the present invention will be appreciated as the same becomes better understood by reference to the following detailed description when considered in connection with the accompanying drawings wherein.

DETAILED DESCRIPTION

Polycrystalline ultra-hard materials, and compacts formed therefrom, are specifically engineered having a polycrystalline ultra-hard material body having a material microstructure that is substantially free of substrate material eruptions, e.g., catalyst material eruptions, and thereby free of localized concentrations, regions or volumes of the catalyst material therein, and substantially free of any other substrate constituent material. Instead, the catalyst material in such polycrystalline ultra-hard material body is evenly dispersed throughout the material microstructure, or throughout at least a region of material microstructure for those embodiments of the invention comprising a region of the body where the catalyst material has been removed therefrom. In an example embodiment, such polycrystalline ultra-hard materials and compacts are formed by controlling the HPHT process, used to sinter the polycrystalline ultra-hard material, to regulate the manner in which the catalyst material melts and is infiltrated into the adjacent ultra-hard material before and during the sintering process.

As used herein, the term "PCD" is used to refer to polycrystalline diamond that has been formed at HPHT conditions through the use of diamond grains or powder and an appropriate catalyst material. In an example embodiment, the catalyst material is a metal solvent catalyst that can include those metals in Group VIII of the Periodic table. The solvent catalyst material remains within interstitial regions of the material microstructure after it has been sintered. However, as described in detail below, the PCD material may be treated to remove the catalyst material from a region thereof. As noted above, the polycrystalline ultra-hard materials of this invention are formed using a HPHT process that is specially controlled to produce a material microstructure that is substantially free of substrate material eruptions, such a catalyst material eruptions, thereby avoiding unwanted localized concentrations, regions or volumes of infiltrated catalyst material or other substrate constituent material within the microstructure.

Figure 1:
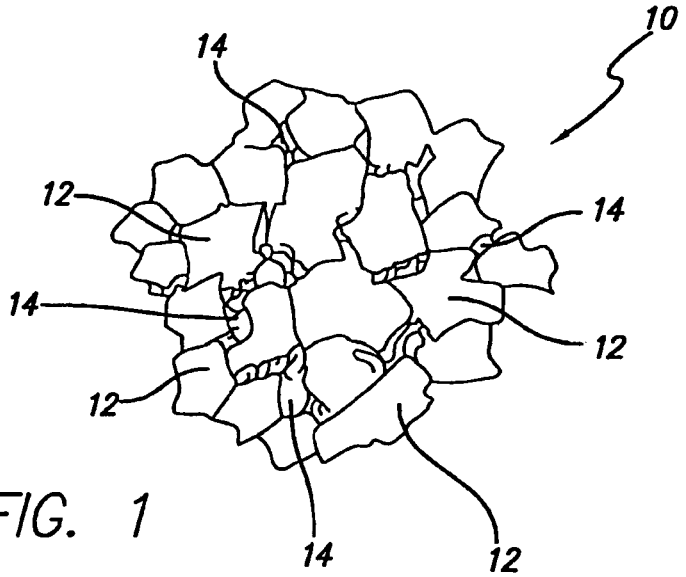
FIG. 1 is schematic microstructural view taken of a region of a polycrystalline ultra-hard material of this invention.

FIG. 1 illustrates a region taken from a polycrystalline ultra-hard material 10 of this invention, and that is shown to have a material microstructure comprising the following material phases. A polycrystalline matrix first material phase 12 comprises a plurality of bonded together ultra-hard crystals formed by the bonding together of adjacent ultra-hard grains at HPHT conditions. A second material phase 14 is disposed interstitially between the bonded together ultra-hard crystals and comprises a catalyst material that is used to facilitate the bonding together of the ultra-hard crystals. As illustrated, a feature of polycrystalline ultra-hard materials of this invention is that the second phase in the material microstructure is not present in the form of localized concentrations, regions or volumes but rather is evenly dispersed throughout the microstructure. The ultra-hard grains used to form the polycrystalline ultra-hard material can include those selected from the group of materials consisting of diamond, cubic boron nitride (cBN), and mixtures thereof. In an example embodiment, the ultra-hard grains that are used are diamond and the resulting polycrystalline ultra-hard material is PCD.

As used herein, the term "catalyst material" is understood to refer to those materials that facilitate the bonding together of the ultra-hard grains during the HPHT process. When the ultra-hard material is diamond grains, the catalyst material facilitates formation of diamond crystals and/or the changing of graphite to diamond or diamond to another carbon-based compound, e.g., graphite.

In the example embodiment where the polycrystalline ultra-hard material is PCD, diamond grains used for forming the resulting diamond-bonded body during the HPHT process include diamond powders having an average diameter grain size in the range of from submicrometer in size to about 0.1 mm, and more preferably in the range of from about 0.002 mm to about 0.08 mm. The diamond powder can contain grains having a mono or multi-modal size distribution. In a preferred embodiment for a particular application, the diamond powder has an average particle grain size of approximately 20 to 25 micrometers.

However, it is to be understood that the diamond grains having a grain size greater than or less than this amount can be used depending on the particular end use application. For example, when the polycrystalline ultra-hard material is provided as a compact configured for use as a cutting element for subterranean drilling and/or cutting applications, the particular formation being drilled or cut may impact the diamond grain selected to provide desired cutting element performance properties. In the event that diamond powders are used having differently sized grains, the diamond grains are mixed together by conventional process, such as by ball or attrittor milling for as much time as necessary to ensure good uniform distribution.

The diamond powder used to prepare the sintered diamond-bonded body can be synthetic diamond powder. Synthetic diamond powder is known to include small amounts of solvent metal catalyst material and other materials entrained within the diamond crystals themselves. Alternatively, the diamond powder used to prepare the diamond-bonded body can be natural diamond powder. The diamond grain powder, whether synthetic or natural, can be combined with a desired amount of catalyst material to facilitate desired intercrystalline diamond bonding during HPHT processing.

Suitable catalyst materials useful for forming the PCD body are metal solvent catalysts that include those metals selected from the Group VIII of the Periodic table, with cobalt (Co) being the most common, and mixtures or alloys of two or more of these materials. The diamond grain powder and catalyst material mixture can comprise from about 85 to 95 percent by volume diamond grain powder and the remaining amount catalyst material. In certain applications, the mixture can comprise greater than about 95 percent by volume diamond grain powder. In an example embodiment, the solvent metal catalyst is introduced into the diamond grain powder by infiltration during HPHT processing from a substrate positioned adjacent the diamond powder volume.

In certain applications it may be desired to have a diamond-bonded body comprising a single diamond-containing volume or region, while in other applications it may be desired that a diamond-bonded body be constructed having two or more different diamond-containing volumes or regions. For example, it may be desired that the diamond-bonded body include a first diamond-containing region extending a distance from a working surface, and a second diamond-containing region extending from the first diamond-containing region to the substrate. Such diamond-containing regions can be engineered having different diamond volume contents and/or be formed using differently sized diamond grains. It is, therefore, understood that polycrystalline ultra-hard materials of this invention may include one or more than one regions comprising different ultra-hard component densities and/or grain sizes, e.g., diamond densities and/or diamond grain sizes, as called for by a particular cutting and/or wear end use application.

In an example embodiment, a measured volume of the diamond grain powder is preferably cleaned, and loaded into a desired container where it is positioned adjacent a desired substrate. The loaded container is configured for placement within a suitable HPHT consolidation and sintering device. An advantage of combining a substrate with the diamond powder volume prior to HPHT processing is that the part that is produced is a compact that includes the substrate bonded to the sintered diamond-bonded body to facilitate eventual attachment of the compact to a desired wear and/or cutting device by conventional method, e.g., by brazing or welding. Additionally, in an example embodiment, the substrate is selected to include a metal solvent catalyst for catalyzing intercrystalline bonding of the diamond grains by infiltration during the HPHT process.

Suitable materials useful as substrates include those materials used as substrates for forming conventional PCD compacts, such as those formed from ceramic materials, metallic materials, cement materials, carbides, nitrides, and mixtures thereof. In a preferred embodiment, the substrate is provided in a preformed rigid state and includes a metal solvent catalyst constituent that is capable of infiltrating into the adjacent diamond powder volume during HPHT processing to facilitate both sintering and providing a bonded attachment with the resulting sintered diamond-bonded body. Suitable metal solvent catalyst materials include those selected from Group VIII elements of the Periodic table as noted above. A preferred metal solvent catalyst is cobalt (Co), and a preferred substrate material is cemented tungsten carbide (WC—Co).

In an example embodiment, the HPHT device is activated to subject the container and its contents to HPHT conditions that are carefully controlled to prevent the rapid melting and infiltration of the catalyst material in the substrate or other substrate constituents that are known to cause the unwanted formation of localized concentrated volumes or regions of the catalyst material or other substrate constituents within the sintered microstructure. The HPHT process is carefully controlled so that the catalyst material is allowed to first melt and then to infiltrate the diamond volume at a measured rate.

In an example embodiment, the HPHT process is controlled by regulating the heating profile to provide at least two different heating stages. During a first heating stage, the HPHT device is controlled to pressurize the container and its contents and subject the container and its contents to a first elevated temperature that is slightly above the melting temperature of the catalyst material. The HPHT device is held at this first stage condition for a set period of time that is calculated to melt the catalyst material and permit a measured rate and extent of infiltration into the diamond grain volume. The exact period of time for this first stage of HPHT processing will depend on a number of factors, such as the type of ultra-hard material used, the type of catalyst material use, the relative amounts of the ultra-hard and catalyst materials used, and the thickness of the ultra-hard material volume.

During this first stage of HPHT processing, the catalyst material is melted at a measured rate and may begin to infiltrate into the adjacent ultra-hard material volume, e.g., diamond grain powder. The degree of catalyst material infiltration during this first stage of HPHT processing can and will vary according to the set temperature and the duration at this temperature that HPHT process is held at the first stage. In an example embodiment, where the ultra-hard material is diamond and the catalyst material is cobalt, the first stage HPHT pressure conditions are in the range of from about 5 to 7 GPa, the temperature conditions are in the range of from about 1,300 to 1,400° C. and the time that the HPHT process is held in this first stage condition is in the range of from about 25 to 300 seconds. It is to be understood that these parameters can and will vary depending on the specifics of the materials being processed as noted above.

As indicated above, during this first stage HPHT process condition it is desired that a partial amount of the melted catalyst material be allowed to infiltrate into the adjacent ultra-hard material volume before the HPHT process is changed to the second stage. In an example embodiment, it is desired after the first stage HPHT process condition the ultra-hard material comprise at least about 10 percent by volume of infiltrated catalyst material. This minimum amount of catalyst material that is infiltrated during first stage HPHT processing is believed to be an amount sufficient to suppress unwanted eruption of the catalyst material into the adjacent ultra-hard material volume when the HPHT process is taken to the second stage.

The amount or degree of catalyst infiltration achieved during the first stage HPHT process can be produced by controlling the first stage HPHT processing time and/or by adjusting the holding temperature. For example, when the ultra-hard material is diamond and the catalyst material is cobalt, the desired degree of cobalt infiltration is achieved during first stage HPHT process conditions of approximately 5.5 GPa, and 1,350° C., that are held for a period of approximately 180 seconds.

While a minimum amount of catalyst material infiltration, of about 10 percent by volume, has been noted, in an example embodiment a desired amount catalyst material infiltration during the first stage HPHT process condition may be in range of from about 20 to 60 percent by volume. Again, it is to be understood that the exact amount of catalyst material infiltration during the first stage of HPHT processing can and will vary on such factors as the type of ultra-hard material, the type of catalyst material, the relative amounts of ultra-hard material and catalyst material, and the thickness of the resulting polycrystalline ultra-hard material layer or body.

However, too little first stage HPHT catalyst infiltration can result in the unwanted occurrence of catalyst material eruptions during second stage HPHT processing, that can result in the unwanted formation and presence of localized concentrations, regions or volumes of the catalyst material within the sintered microstructure. Also, too much catalyst infiltration during first stage of HPHT processing may not be desired because such a volume of the catalyst material infiltrated during the first stage can produce a high barrier for achieving further catalyst material infiltration. If this situation occurs, it may not be possible to create the driving force needed during the second stage HPHT process to overcome such high barrier to achieve the further degree of catalyst material infiltration that is needed to ensure that the remaining extent of the ultra-hard material is fully infiltrated and finally well sintered.

During this first stage HPHT processing condition, some sintering of the ultra-hard material will take place. Generally speaking, the portion of the ultra-hard material that undergoes sintering during this first stage HPHT processing condition is the portion that has been infiltrated by the catalyst material.

After completion of the first stage HPHT process condition, the partially sintered contents of the container was examined and the material microstructure was characterized as having a diamond mixture volume comprising a first region adjacent to the substrate that was rich in the infiltrated catalyst material. This first region extended a distance of about 100 to 800 micrometers from the interface of the substrate and was free of any substrate material, e.g.., catalyst material, eruptions, and any localized concentrations, regions or volumes of catalyst material or other substrate constituent material associated with such eruptions. The material microstructure of the diamond volume included a second region that was free of the infiltrated catalyst material. The second region extended from the end of the first region all the way up to a top surface of the compact.

While this second region was free of catalyst material infiltrated from the substrate, it is understood that such second region may contain residual amounts of catalyst material present, e.g., from premixing with the diamond mixture. In an example embodiment, the interface between the first and second regions, after completion of the first stage HPHT processing, can be within the range of from about 10 to 80 percent of the thickness of the total diamond volume as measured from the substrate interface, and preferably within the range of from about 25 to 60 percent of the thickness.

After the predetermined amount of time has passed, the HPHT device is controlled to achieve a second HPHT processing condition. The second HPHT condition is achieved by increasing the temperature to a temperature sufficient to cause the ultra-hard material to become a fully sintered product at the HPHT pressure conditions. During transition from the first to the second stage of HPHT processing, the pressure that is imposed on the container and its contents remains constant. In an example, wherein the ultra-hard material is diamond and the catalyst material is cobalt, the second stage of HPHT processing is achieved by raising the temperature from the first stage temperature condition to about 1,400 to 1,600° C.

The second stage HPHT process is conducted for a period of time sufficient to produce a fully sintered product. This period of time will of course vary depending on the nature of the material mixture being processed, but for those ultra-hard materials described herein is expected to be within the range of from about 180 to 600 seconds. In an example embodiment, where the ultra-hard material is diamond and the catalyst material is cobalt, the second stage HPHT process is conducted for a period of time of approximately 240 to 300 seconds. It is to be understood that the exact duration of amount of time of second stage HPHT processing will depend on many of the same factors noted above for the first stage HPHT process condition, and in addition it will depend on the degree of catalyst material infiltration achieved during the first stage HPHT process condition.

During this second stage of HPHT processing, the remaining amount of catalyst material to be infiltrated into the adjacent ultra-hard material volume infiltrates into the adjacent ultra-hard material volume to facilitate intercrystalline diamond bonding and bonding of the resulting diamond-bonded body to the substrate. During the second stage, both catalyst material in the substrate infiltrates into the ultra-hard material volume, and catalyst material that has already entered the ultra-hard material volume infiltrates into the ultra-hard material volume a further degree. During formation of the sintered diamond-bonded body, the catalyst material migrates into interstitial regions disposed between the diamond-bonded grains. A key result that occurs from using this two stage HPHT process is the formation of a polycrystalline ultra-hard material having a material microstructure that is free of catalyst material eruptions, and that includes the catalyst material evenly dispersed throughout the resulting microstructure, thereby avoiding the unwanted presence of localized concentrations, regions or volumes of the catalyst material extending in an uninterrupted fashion through the microstructure.

Figure 2A:
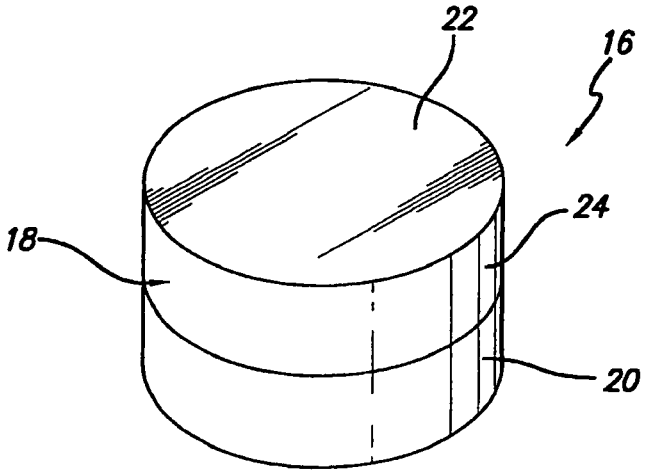
FIGS. 2A to 2E are perspective views of different PCD compacts formed from polycrystalline ultra-hard materials of this invention.
Figure 2B:
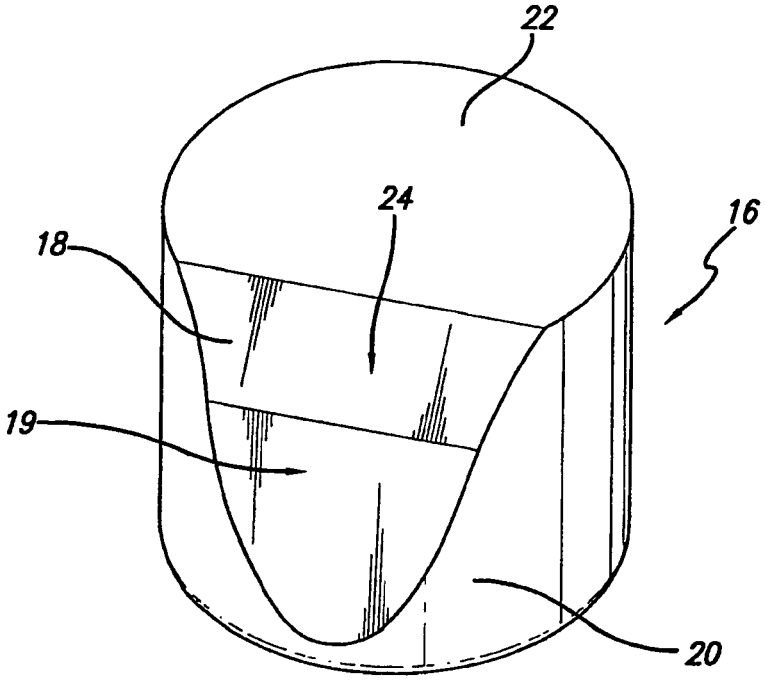
Figure 2C:
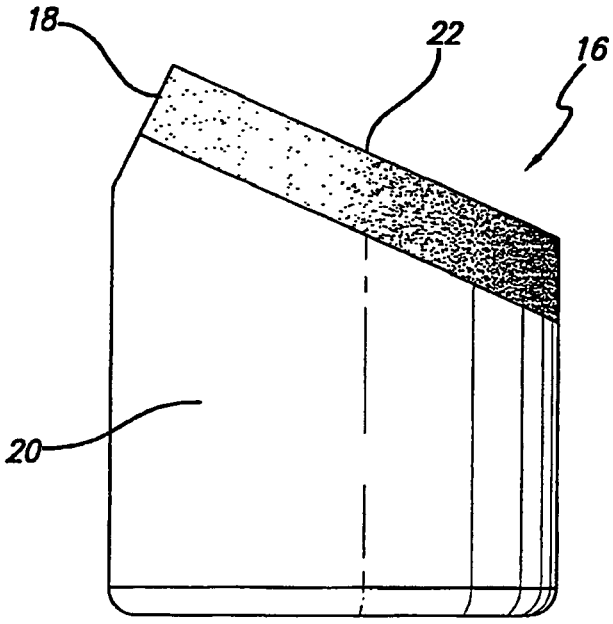
Figure 2D:
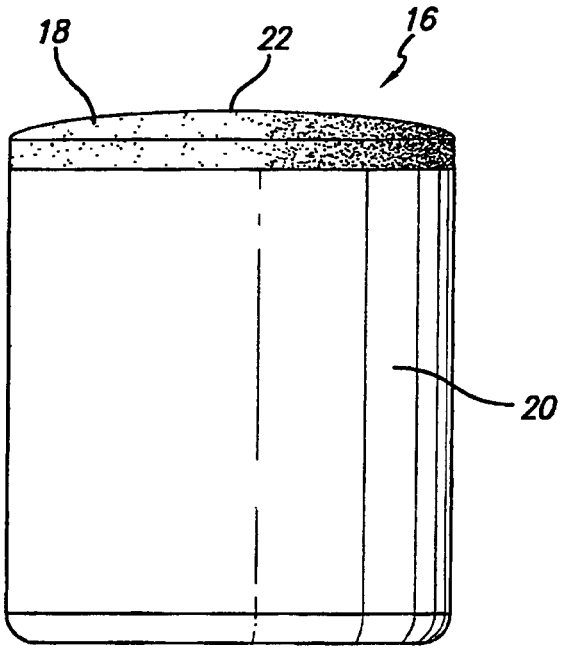
Figure 2E:
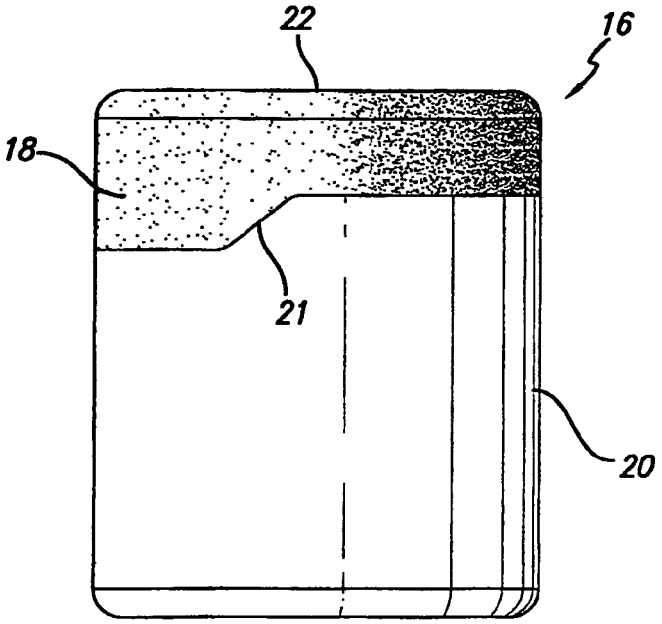

FIG. 2A illustrates a PCD compact 16 formed according to this controlled HPHT process comprising a body 18 formed from the sintered polycrystalline ultra-hard material, e.g., PCD, and a substrate 20 attached thereto. The body, e.g., a diamond-bonded body, includes a working surface 22 positioned at a desired location along an outside surface portion of the diamond body 18. In the example embodiment illustrated in FIG. 2A, the diamond body 18 and substrate 20 are each configured in the form of generally cylindrical members, and the working surface 22 is positioned along an axial end of the compact across a diamond table of the diamond body 18.

It is to be understood that polycrystalline ultra-hard materials constructed in the form of compacts can be configured differently than that described above and illustrated in FIG. 2A, e.g., having an ultra-hard material body mounted differently on the substrate and/or having the working surface positioned differently along the body and/or differently relative to the substrate, and/or having an ultra-hard material body and/or substrate geometry that is not necessarily cylindrical. FIGS. 2B to 2E illustrate polycrystalline ultra-hard material compact embodiments, constructed according to principles of this invention, that are configured differently than that illustrated in FIG. 2A for purposes of reference to demonstrate such differences.

As used herein, the terms "substantially free of catalyst material eruptions" is understood to mean that the sintered material microstructure does not include localized concentrations, regions or volumes of catalyst material that extend in an uninterrupted fashion outwardly from the substrate and at least partially into the polycrystalline ultra-hard material.

Figure 3:
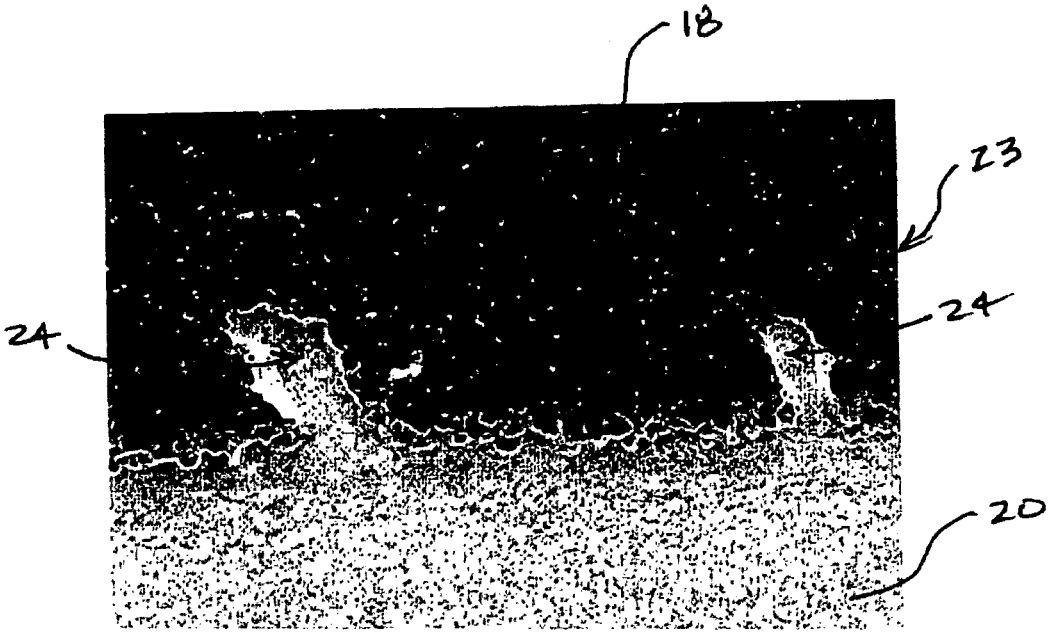
FIG. 3 is a photomicrograph of a region taken of a conventional PCD material comprising catalyst material eruptions.

FIG. 3 is a photomicrograph taken of region of a conventional PCD material 23 formed using a single HPHT process, resulting in unwanted substrate material eruptions that produce localized concentrations 24, regions or volumes of the catalyst material or other substrate constituent material. The localized concentrations 24 of the catalyst material generally appear in the form of columns that extend from the substrate 20 into the polycrystalline ultra-hard material 18. As illustrated, such localized concentrations 24 project into the polycrystalline ultra-hard material 18, and have a distinct depth and thickness. As used herein, such unwanted localized concentrations, regions or volumes are understood to have a minimum depth (as measured extending outwardly from the substrate) of greater than about 15 micrometers, and have a minimum thickness (as measured diagonally through the concentrated region) that is greater than an average distance between adjacent ultra-hard material particles (as measured along an arbitrary straight line through the sintered material). For example, when the polycrystalline ultra-hard material is polycrystalline diamond, the minimum thickness is greater than an average distance between adjacent diamond crystals.

The catalyst material of polycrystalline ultra-hard materials of this invention is evenly dispersed throughout the sintered microstructure in a manner that does not interfere with the structure of other phases of the microstructure, e.g., that does not interfere with the structure of the polycrystalline phase. Such even dispersement of the catalyst material is made in reference to the polycrystalline phase and the bonded-together crystals or particles within this phase. In an example embodiment, the catalyst material is dispersed within the polycrystalline phase and between the bonded-together crystals such that there are none of the above-noted uninterrupted localized concentrations, regions or volumes of the catalyst region within the microstructure.

Once formed, for certain end use applications calling for an improved degree of thermal stability, it may be desired that the diamond-bonded body 18 be treated to remove the catalyst material from a selected region thereof. This can be done, for example, by removing substantially all of the catalyst material from the selected region by suitable process, e.g., by acid leaching, aqua regia bath, electrolytic process, chemical processes, electrochemical processes or combinations thereof.

It is desired that the selected region where the catalyst material is to be removed, or the region of the diamond-bonded body that is to be rendered substantially free of the catalyst material, be one that extends a determined depth from a surface, e.g., a working or cutting surface, of the diamond-bonded body independent of the working or cutting surface orientation. Again, it is to be understood that the working or cutting surface may include more than one surface portion of the diamond-bonded body.

In an example embodiment, it is desired that the region rendered substantially free of the catalyst material extend from a working or cutting surface of the diamond-bonded body a depth that is calculated to sufficient to provide a desired improvement in thermal stability to the diamond body. Thus, the exact depth of this region is understood to vary depending on such factors as the diamond density, the diamond grain size, the ultimate end use application, and the desired increase in thermal stability.

In an example embodiment, the region can extend from the working surface to an average depth of less than about 0.1 mm, preferably extend from a working or cutting surface an average depth of from about 0.02 mm to an average depth of less than about 0.09 mm, and more preferably extend from a working or cutting surface an average depth of from about 0.04 mm to an average depth of about 0.08 mm. In another example embodiment, e.g., for more aggressive tooling, cutting and/or wear applications where an even greater degree of thermal stability is needed, the region rendered substantially free of the catalyst material can extend a depth from the working surface of greater than about 0.1 mm.

The diamond-bonded body can be machined to its approximate final dimension prior to treatment. Alternatively, the PCD compact can be treated first and then machined to its final dimension. The targeted region for removing the catalyst material can include any surface region of the diamond-bonded body, including, and not limited to, the diamond table, a beveled section extending around and defining a circumferential edge of the diamond table, and/or a sidewall portion extending axially a distance away from the diamond table towards or to the substrate interface. Accordingly, in some example embodiment, the region rendered substantially free of the catalyst material can extend along the diamond table and then around the sidewall surface of the diamond-bonded body a distance that may reach the substrate interface.

It is to be understood that the depth of the region removed of the catalyst material is represented as being a nominal, average value arrived at by taking a number of measurements at preselected intervals along this region and then determining the average value for all of the points. The remaining/untreated region of the diamond-bonded body is understood to still contain the catalyst material uniformly distributed therein, and comprises the polycrystalline diamond material described above.

Additionally, when the diamond-bonded body is treated, it is desired that the selected depth of the region to be rendered substantially free of the catalyst material be one that allows a sufficient depth of remaining PCD so as to not adversely impact the attachment or bond formed between the diamond-bonded body and the substrate. In an example embodiment, it is desired that the untreated or remaining PCD region within the diamond-bonded body have a thickness of at least about 0.01 mm as measured from the substrate. It is, however, understood that the exact thickness of the remaining PCD region can and will vary from this amount depending on such factors as the size and configuration of the compact, and the particular PCD compact application.

In an example embodiment, the selected region of the diamond-bonded body to be removed of the catalyst material is treated by exposing the desired surface or surfaces of the diamond-bonded body to acid leaching, as disclosed for example in U.S. Pat. No. 4,224,380, which is incorporated herein by reference. Generally, after the diamond-bonded body or compact is made according to the HPHT process described above, the identified body surface or surfaces, e.g., the working and/or cutting surfaces, are placed into contact with the acid leaching agent for a sufficient period of time to produce the desired leaching or catalyst material depletion depth.

Suitable leaching agents for treating the selected region include materials selected from the group consisting of inorganic acids, organic acids, mixtures and derivatives thereof. The particular leaching agent that is selected can depend on such factors as the type of catalyst material used, and the type of other non-diamond metallic materials that may be present in the diamond-bonded body. In an example embodiment, suitable leaching agents include hydrofluoric acid (HF), hydrochloric acid (HCl), nitric acid ($HNO_3$), and mixtures thereof.

In an example embodiment, where the diamond-bonded body to be treated is in the form of a compact, the compact is prepared for treatment by protecting the substrate surface and other not-to-be treated portions of the diamond-bonded body adjacent the desired treated region from contact (liquid or vapor) with the leaching agent. Methods of protecting the substrate surface include covering, coating or encapsulating the substrate and portion of PCD body with a suitable barrier member or material such as wax, plastic or the like.

Figure 4:
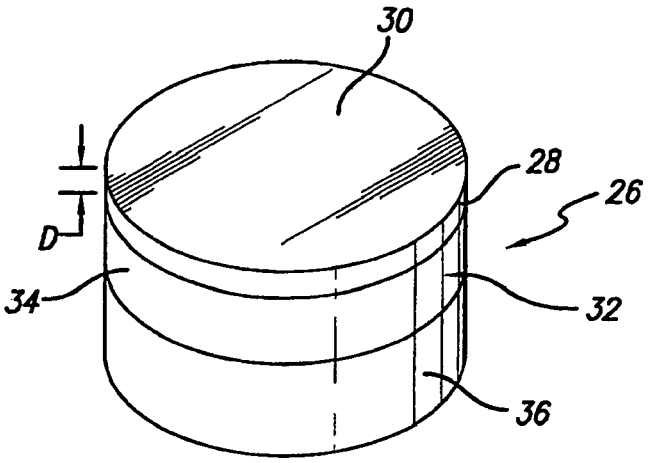
FIG. 4 is a perspective view of a PCD compact comprising a polycrystalline ultra-hard material that has been treated to remove the catalyst material from at least a region thereof.
Figure 5:
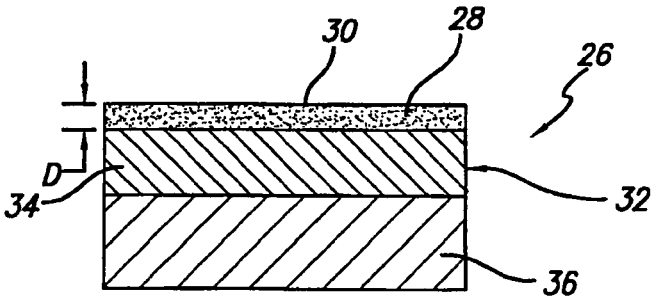
FIG. 5 is a cross-sectional side view of the PCD compact of FIG. 4.

FIGS. 4 and 5 illustrate example embodiments of the polycrystalline ultra-hard material compacts of this 26 of this invention that have been treated to remove the catalyst material from a selected diamond-bonded body region. The compact 26 comprises a treated region 28 that extends a selected depth "D" from a working or cutting surface 30 of the diamond-bonded body 32. The remaining region 34 of the diamond-bonded body 32, extending from the treated region 28 to the substrate 36, comprises PCD having the catalyst material intact and uniformly distributed therein as described above. As noted earlier, the exact depth of the treated region having the catalyst material removed therefrom can and will vary.

Additionally, as mentioned briefly above, it is to be understood that the polycrystalline ultra-hard material compacts described above and illustrated in FIGS. 4 and 5 are representative of a single example of compact embodiment having improved thermal stability by virtue of removing the catalyst material from a region thereof, and that such compacts can be constructed other than that specifically described and illustrated while being within the scope of this invention. For example, polycrystalline ultra-hard material compacts comprising a diamond-bonded body having a treated region and then two or more other diamond-bonded regions are possible, wherein a region interposed between the treated region and the region adjacent the substrate may be a transition region having a different diamond density and/or be formed from diamond grains sized differently from that of the other diamond-bonded regions.

Figure 6:
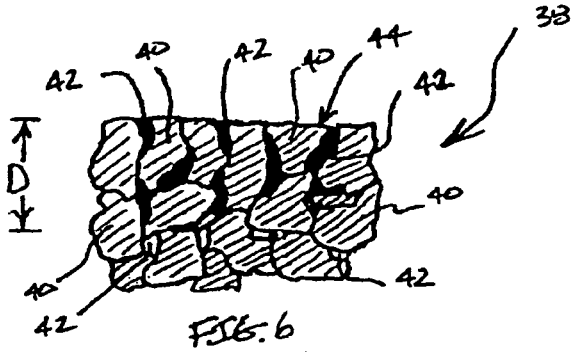
FIG. 6 is a schematic microstructural view taken from the treated region of the PCD compact of FIGS. 4 and 5.

FIG. 6 illustrates a representative material microstructure 38 of the example embodiment polycrystalline ultra-hard material compact described above comprising the diamond-bonded region rendered thermally stable by removing the catalyst material therefrom. More specifically, FIG. 3 illustrates a section of the treated region of the compact. The treated region comprises a matrix phase of intercrystalline bonded diamond formed from a plurality of bonded together diamond grains 40. The treated region also includes a plurality of interstitial regions 42 interposed between the diamond grains or crystals that are now substantially free of the catalyst material. The treated region is shown to extend a distance "D" from a working or cutting surface 44 of the diamond-boded body.

While particular embodiments of polycrystalline ultra-hard material compacts comprising a diamond-bonded region removed of the catalyst material have been descried and illustrated, it is to be understood that such compacts can be shaped and/or configured different from that illustrated, e.g., in FIG. 4. Such compact embodiment can be configured having a variety of different shapes and sizes depending on the particular wear and/or cutting application, e.g., such as those illustrated for the compact embodiments in FIGS. 2B to 2E.

While particular first and second stage HPHT processing conditions, e.g., pressures, temperatures and times, have been provided it is to be understood that one or more of these process variables may change depending on such factors as the type and amount of catalyst material, and/or the type of ultra-hard material, and/or the relative amounts of the catalyst material and ultra-hard material, and/or the thickness of the polycrystalline ultra-hard material layer or body. A key point, however, is that during the first stage HPHT process, the temperature be controlled so that it be sufficient melt and cause the desired degree of catalyst material infiltration as noted above. The above described polycrystalline ultra-hard materials and compacts formed therefrom of this invention will be better understood with reference to the following example:

EXAMPLE

Polycrystalline Ultra-Hard Material Compact

Synthetic diamond powder having an average grain size of approximately 2 to 50 micrometers was mixed together for a period of approximately 2 to 6 hours by ball milling. The resulting mixture was cleaned by processing in a hydrogen reduction furnace cycle. The mixture was loaded into a refractory metal container. A WC—Co substrate was positioned adjacent a surface of the diamond powder volume. The container was surrounded by pressed salt (NaCl) and this arrangement was placed within a graphite heating element. This graphite heating element containing the pressed salt and the diamond powder and substrate encapsulated in the refractory container was then loaded in a vessel made of a high pressure/high temperature self-sealing powdered ceramic material formed by cold pressing into a suitable shape.

The self-sealing powdered ceramic vessel was placed in a hydraulic press having one or more rams that press anvils into a central cavity. The press was operated to impose a first stage HPHT process condition of approximately 5,500 MPa and approximately 1,350° C. on the vessel for a period of approximately 150 seconds. During this first stage HPHT process condition, cobalt from the WC—Co substrate was melted and started to infiltrate into an adjacent region of the diamond powder mixture. During this first stage HPHT process condition, greater than about 10 percent by volume of the cobalt infiltrated into the adjacent diamond powder mixture.

The press was then operated to impose a second stage HPHT process condition of approximately 5,500 MPa and approximately 1500° C. on the vessel for a period of approximately 300 seconds. During this second stage HPHT process condition, further melted cobalt from the WC—Co substrate infiltrated into the diamond powder mixture, intercrystalline bonding between the diamond crystals and bonding took place forming a fully sintered PCD body, and bonding between the PCD body and the substrate took place forming a PCD compact.

The vessel was opened and the resulting PCD compact was removed therefrom. The microstructure of the PCD body was examined and found to have a microstructure comprising a polycrystalline diamond matrix substantially free of any substrate material, e.g., cobalt, eruptions. Rather, the cobalt catalyst material was observed to be dispersed evenly or in a uniform manner throughout the microstructure. There were no signs of substrate material eruptions into the PCD body, and no signs of unwanted localized concentrations, regions or volumes of any substrate constituent material, e.g., cobalt, extending through the polycrystalline diamond matrix.

A key feature of polycrystalline ultra-hard materials and compacts comprising the same, formed in accordance with the principles of this invention, is that they comprise an ultra-hard material body having a material microstructure that is substantially free of substrate material eruptions. The controlled processing of such materials and compacts using the above-described multi-stage HPHT process avoids unwanted catalyst material or other substrate constituent material eruption during formation, thereby avoiding the formation of a sintered product having an unwanted presence of localized concentrations, regions or volumes of catalyst material or other substrate constituent within the sintered microstructure.

Such localized catalyst material or other substrate constituent material concentrations caused by such eruptions are known to appear in the form of columns that extend outwardly away from the substrate and through the adjacent polycrystalline ultra-hard material body. The catalyst material columns can: (1) interfere with the effective catalytic formation of the polycrystalline ultra-hard matrix; (2) have an adverse impact on the mechanical physical properties of fracture toughness and strength of the resulting sintered product as it operates to interrupt the structure of the polycrystalline matrix; and (3) effectively reduce the thermal stability of the sintered product due to the relative thermal expansion differences between the concentrated catalyst material volumes and the polycrystalline matrix material surrounding such localized catalyst material concentrations.

Polycrystalline ultra-hard materials and compacts of this invention can be used in a number of different applications, such as tools for mining, cutting, machining and construction applications, where the combined properties of thermal stability, strength/toughness, and wear and abrasion resistance are highly desired. Polycrystalline ultra-hard materials and compacts of this invention are particularly well suited for use as working, wear and/or cutting components in machine tools and drill and mining bits, such as roller cone rock bits, percussion or hammer bits, diamond bits, and shear cutters used for drilling subterranean formations.

Figure 7:
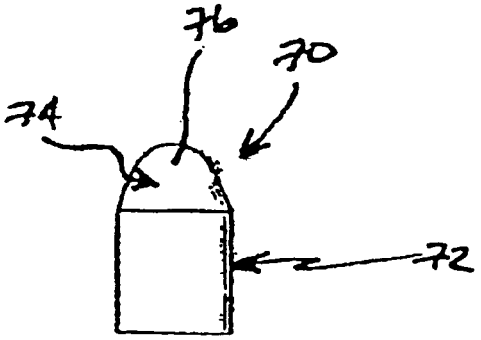
FIG. 7 is a perspective side view of an insert, for use in a roller cone or a hammer drill bit, comprising the compacts formed from polycrystalline ultra-hard materials of this invention.

FIG. 7 illustrates an embodiment of a polycrystalline ultra-hard material compact of this invention provided in the form of an insert 70 used in a wear or cutting application in a roller cone drill bit or percussion or hammer drill bit. For example, such inserts 70 can be formed from blanks comprising a substrate 72 formed from one or more of the substrate materials disclosed above, and a diamond-bonded body 74 having a working surface 76. The blanks are pressed or machined to the desired shape of a roller cone rock bit insert.

Figure 8:
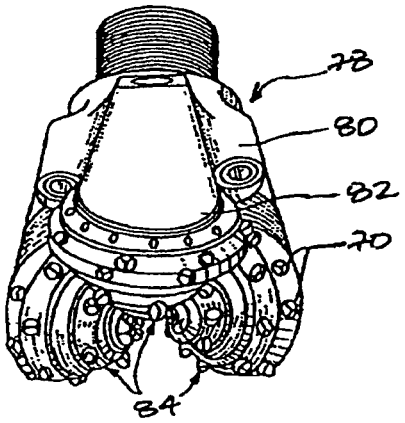
FIG. 8 is a perspective side view of a roller cone drill bit comprising a number of the inserts of FIG. 7.

FIG. 8 illustrates a rotary or roller cone drill bit in the form of a rock bit 78 comprising a number of the wear or cutting inserts 70 disclosed above and illustrated in FIG. 7. The rock bit 78 comprises a body 80 having three legs 82, and a roller cutter cone 84 mounted on a lower end of each leg. The inserts 70 can be fabricated according to the method described above. The inserts 70 are provided in the surfaces of each cutter cone 84 for bearing on a rock formation being drilled.

Figure 9:
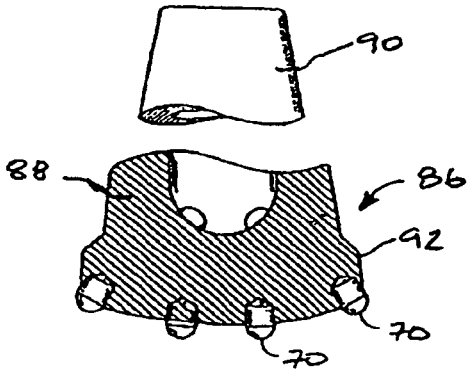
FIG. 9 is a perspective side view of a percussion or hammer bit comprising a number of the inserts of FIG. 7.

FIG. 9 illustrates the inserts 70 described above as used with a percussion or hammer bit 86. The hammer bit comprises a hollow steel body 88 having a threaded pin 90 on an end of the body for assembling the bit onto a drill string (not shown) for drilling oil wells and the like. A plurality of the inserts 70 is provided in the surface of a head 92 of the body 88 for bearing on the subterranean formation being drilled.

Figure 10:
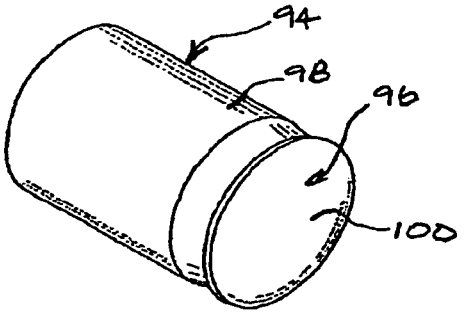
FIG. 10 is a schematic perspective side view of a diamond shear cutter comprising the compacts formed from the polycrystalline ultra-hard materials of this invention.

FIG. 10 illustrates a polycrystalline ultra-hard material compact of this invention as embodied in the form of a shear cutter 94 used, for example, with a drag bit for drilling subterranean formations. The shear cutter 94 comprises a diamond-bonded body 96 that is sintered or otherwise attached to a cutter substrate 98. The diamond-bonded body 96 includes a working or cutting surface 100. Shear cutters comprising the polycrystalline ultra-hard material compact of this invention can also be configured differently from that illustrated in FIG. 10, e.g., they can be configured as illustrated in FIGS. 2B to 2E.

Figure 11:
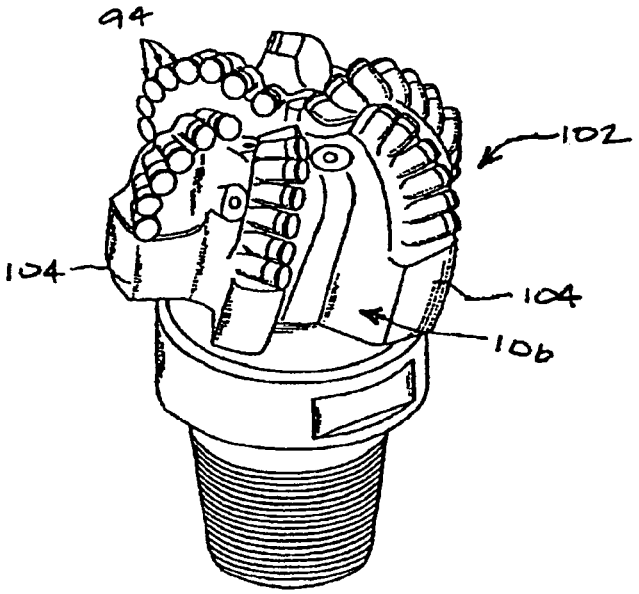
FIG. 11 is a perspective side view of a drag bit comprising a number of the shear cutters of FIG. 10.

FIG. 11 illustrates a drag bit 102 comprising a plurality of the shear cutters 94 described above and illustrated in FIG. 10. The shear cutters are each attached to blades 104 that extend from a head 106 of the drag bit for cutting against the subterranean formation being drilled.

Other modifications and variations of polycrystalline ultra-hard materials and compacts formed therefrom will be apparent to those skilled in the art. It is, therefore, to be understood that within the scope of the appended claims, this invention may be practiced otherwise than as specifically described.

What is claimed is:

1. A polycrystalline ultra-hard material compact comprising:

an ultra-hard material body comprising a polycrystalline diamond phase of bonded together diamond crystals, and a catalyst material disposed in a plurality of interstitial regions between diamond crystals within the polycrystalline diamond phase; and a substrate attached to the ultra-hard material body and comprising a catalyst material;

wherein the ultra-hard material body is substantially free of eruptions of the catalyst material extending outwardly away from substrate along an entirety of an interface between the body and the substrate at least a partial depth into the ultra-hard material body that is greater than about 15 micrometers as measured from the interface.

2. The polycrystalline ultra-hard material compact as recited in claim 1 wherein the eruptions of the catalyst material have a thickness that is greater than an average distance between adjacent diamond crystals in the body.

3. The polycrystalline ultra-hard material compact as recited in claim 1 wherein ultra-hard body comprises a first region and a second region each including the polycrystalline diamond phase, wherein the first region is substantially free of the catalyst material and extends from a working surface of the body a depth of less than about 0.1 mm, and wherein the second region includes the catalyst material.

4. The polycrystalline ultra-hard material compact as recited in claim 1 wherein the ultra-hard material body is prepared by the process of:

subjecting a substrate and a volume of precursor ultra-hard material to a first high pressure/high temperature condition; and then subjecting the substrate and volume of precursor ultra-hard material to a second high pressure/high temperature condition;

wherein the temperature of the first high pressure/high temperature condition is lower than that of the second high pressure/high temperature condition.

5. The polycrystalline ultra-hard material compact as recited in claim 4 wherein after the first high pressure/high temperature condition, but before the second high pressure/high temperature condition, the precursor ultra-hard material comprises at least about 10 percent by volume of the catalyst material.

6. The polycrystalline ultra-hard material compact as recited in claim 4 wherein after the first high pressure/high temperature condition, but before the second high pressure/high temperature condition, the precursor ultra-hard volume comprises in the range of from about 20 to 50 percent by volume of the catalyst material.

7. The polycrystalline ultra-hard material compact as recited in claim 1 wherein the ultra-hard material body comprises a first region having a first diamond volume content, and a second region having a diamond volume content that is different from that of the first region.

8. The polycrystalline ultra-hard material compact as recited in claim 1 wherein the ultra-hard material body comprises a first region formed from diamond grains having a first average particle size, and a second region formed from diamond grains having a second average particle size that is different from the first average particle size.

9. A polycrystalline ultra-hard material formed by the process of:

placing a volume of precursor ultra-hard material adjacent to a substrate comprising a catalyst material to form a combination;

subjecting the combination to a first high pressure/high temperature condition sufficient to cause the catalyst material to melt and partially infiltrate the volume of precursor ultra-hard material; and subjecting the combination to a second high pressure/high temperature condition to cause the catalyst material to further infiltrate the volume of precursor ultra-hard material and promote intercrystalline bonding to form a fully sintered product, wherein the temperature of the second high pressure/high temperature condition is higher than that of the first high pressure/high temperature condition;

wherein the fully sintered product comprises an ultra-hard material body that is substantially free of uninterrupted concentrated regions of the catalyst material extending outwardly away from substrate along an entirety of an interface between the body and the substrate at least a partial depth into the ultra-hard material body that is greater than about 15 micrometers as measured from the interface.

10. The polycrystalline ultra-hard material as recited in claim 9 wherein after the first high pressure/high temperature condition the precursor ultra-hard material comprises at least about 10 percent by volume of the catalyst material.

11. The polycrystalline ultra-hard material as recited in claim 9 wherein after the first high pressure/high temperature condition the precursor ultra-hard material comprises from about 20 to 60 percent by volume of the catalyst material.

12. The polycrystalline ultra-hard material as recited in claim 9 wherein after the first high pressure/high temperature condition, the volume of precursor ultra-hard material comprises a first region and a second region, wherein the first region extends a distance from an interface between the volume and the substrate and comprises the infiltrated catalyst material, and wherein the second region extends from an interface with the first region and is substantially free of the infiltrated catalyst material.

13. The polycrystalline ultra-hard material as recited in claim 12 wherein after the first high pressure/high temperature condition the volume of precursor ultra-hard material comprises a first region and a second region, wherein the interface between the first and second region can be within the range of from about 10 to 80 percent of the total thickness of the volume of precursor ultra-hard material as measured from an interface with the substrate.

14. The polycrystalline ultra-hard material as recited in claim 12 wherein after the first high pressure/high temperature condition the volume of precursor ultra-hard material comprises a first region and a second region, wherein the interface between the first and second region can be within the range of from about 25 to 60 percent of the total thickness of the volume of precursor ultra-hard material as measured from an interface with the substrate.

15. The polycrystalline ultra-hard material as recited in claim 9 wherein the pressure during the first and second high pressure/high temperature conditions is the same.

16. The polycrystalline ultra-hard material as recited in claim 9 wherein the temperature during the first high pressure/high temperature condition is sufficient to melt and infiltrate a partial volume of the catalyst material but not enough to sinter the entire volume of precursor ultra-hard material.

17. The polycrystalline ultra-hard material as recited in claim 9 wherein the volume of precursor ultra-hard material comprises diamond grains, and wherein the catalyst material is selected from the group consisting of Co, Fe, Ni, and mixtures thereof.

18. The polycrystalline ultra-hard material as recited in claim 17 wherein the fully sintered product has a material microstructure comprising a polycrystalline diamond phase of bonded together diamond crystals, and the catalyst material is disposed in a plurality of interstitial regions within the diamond phase.

19. A polycrystalline ultra-hard material formed by the process of:

placing a volume of precursor ultra-hard material adjacent to a substrate comprising a catalyst material to form a combination;

subjecting the combination to a first high pressure/high temperature condition sufficient to cause the catalyst material to melt and partially infiltrate the volume of precursor ultra-hard material; and subjecting the combination to a second high pressure/high temperature condition to cause the catalyst material to further infiltrate the volume of precursor ultra-hard material and promote intercrystalline bonding to form a fully sintered product, wherein the temperature of the second high pressure/high temperature condition is higher than that of the first high pressure/high temperature condition;

wherein the fully sintered product comprises an ultra-hard material body that is substantially free of eruptions of the catalyst material extending outwardly away from substrate along an entirety of an interface between the body and the substrate at least a partial depth into the ultra-hard material body, wherein such eruptions have a thickness that is greater than an average distance between adjacent ultra-hard particles in the ultra-hard material body.

* * * * *